United States Patent [19]

Alvemarker

[11] Patent Number: 4,804,488

[45] Date of Patent: Feb. 14, 1989

[54] BLASTING BODIES ADAPTED FOR CLEANING UTENSILS IN DISH-WASHING MACHINES

[76] Inventor: Arne Alvemarker, Målaregården 3,, S-24021 Löddeköpinge, Sweden

[21] Appl. No.: 817,940

[22] PCT Filed: Mar. 27, 1985

[86] PCT No.: PCT/SE85/00135

§ 371 Date: Nov. 26, 1985

§ 102(e) Date: Nov. 26, 1985

[87] PCT Pub. No.: WO85/04318

PCT Pub. Date: Oct. 10, 1985

[30] Foreign Application Priority Data

Mar. 27, 1984 [SE] Sweden ..... 8401695

[51] Int. Cl.[4] ..... C11D 3/37; C11D 7/20; C11D 17/00

[52] U.S. Cl. ..... 252/544; 134/7; 134/25.1; 134/25.4; 134/25.2; 134/38; 51/298; 15/3; 15/95; 252/174.23; 252/174.25

[58] Field of Search ..... 134/25.4, 25.1, 167 R, 134/25.2, 7, 38; 51/320, 298, 292, 317; 252/174.25, 140, 174.23, 544; 15/3, 95

[56] References Cited

U.S. PATENT DOCUMENTS

| | | | |
|---|---|---|---|
| 2,189,761 | 2/1940 | McKenna | 15/95 |
| 3,272,650 | 9/1966 | MacVittie | 15/95 |
| 3,323,159 | 6/1967 | Ummel et al. | 15/3 |
| 3,424,616 | 1/1969 | Townsend | 134/7 |
| 4,333,771 | 6/1982 | Altenschopfer et al. | 252/140 |
| 4,374,433 | 2/1983 | Mosell | 134/7 |

FOREIGN PATENT DOCUMENTS

| | | | |
|---|---|---|---|
| 0016895 | 10/1980 | European Pat. Off. . | |
| 8073585 | 5/1983 | Japan | 134/7 |
| 7908348-1 | 8/1981 | Sweden . | |

*Primary Examiner*—H. M. S. Sneed
*Assistant Examiner*—Sharon T. Cohen
*Attorney, Agent, or Firm*—Young & Thompson

[57] ABSTRACT

Blasting bodies, for use in dishwashing machines in admixture with dishwashing water, comprise about 60% by weight mineral filler selected from the group consisting of silicate, sulphate and carbonate. A plastic selected from the group consisting of polyamide and polyethylene is present as a binder for the mineral filler, which is in the form of particles. The bodies have a specific gravity of at least 2.0 and a Moh's hardness value of at least 3.0, each body having a weight of about 0.04 g, a length of about 3 mm and a width of about 2.5 mm and being circular or polygonal in transverse section. Preferably, the bodies contain at least one percent by weight chalk, and the mineral filler is barium sulphate.

8 Claims, No Drawings

BLASTING BODIES ADAPTED FOR CLEANING UTENSILS IN DISH-WASHING MACHINES

The present invention relates to dish-washing machines which operate with blasting bodies mixed into the dish-washing water, this water being sprayed through nozzles against the utensils in a dish-washing compartment in a dishwasher, so as to dislodge and remove food residues present on the utensils. Upon completion of a working cycle, the water is, in the majority of cases, passed through a sieve or strainer, to separate the blasting bodies from the dish-washing water and collect the bodies for re-use in the dishwasher. In certain machines the blasting bodies settle in the machine as the dish-washing water is removed therefrom and are then introduced into the fresh dish-washing water. This wet-blasting technique has been known in many different forms for the last 20 years, as is evident from, for example, the German published Specifications Nos. 1 151 906, 1 148 360, 1 220 095, 1, 428 456, the Finnish Published Specification No. 47 722 and the U.S. Pat. Nos. 3,323,159, 3,272,650 and 4,374,443. In certain cases the blasting bodies used have the form of metal spheres, sand, crushed marble, or other heavy and hard-blasting material. One disadvantage with blasting bodies of such hardness, e.g. crushed marble, is that they cause wear on the utensils being washed. In other instances, the blasting bodies have the form of light-weight plastics pellets, which float around in the dish-washing water. The plastics from which such pellets are made may be a relatively hard plastics, such as Delrin®.

SUMMARY OF THE INVENTION

The object of the present invention is to provide blasting bodies of such properties that their advantages are greater than those of hitherto known blasting bodies for wet-blasting purposes, certain properties of the blasting bodies being advantageous in more than one respect. This is achieved by using for dish-washing purposes blasting bodies of the kind set forth in the following main claim.

The blasting bodies according to the invention can be produced relatively cheaply. This is achieved by forming a composite mix in which one constituent comprises a relatively inexpensive plastics, such as polyamide or polyethylene which is considerably cheaper than the previously used plastics Delrin® and which, in addition, has a much greater resistance to heat and alkali. The plastics is mixed with a known inexpensive filler forming a further constituent of the mix. Such fillers comprise powderous mineral fillers such as silicate, sulphate or carbonate. Barium sulphate can also be used to advantage. By mixing such mineral fillers in percent by weight, in quantities of about 60% by weight, the plastics will serve as an effective binder for the hard mineral particles, which are wear-resistant and therewith lengthen the useful life-span of the blasting bodies, thereby greatly reducing running costs in relation to hitherto known blasting pellets made of Delrin®.

The filler should have a hardness greater than 3.0 measured according to Moh's hardness scale. Admixture of filler in amounts corresponding to about 60% by weight results in a considerable increase in the specific gravity of the blasting bodies and therewith the weight of the individual bodies of given shape and size, which is a considerable advantage in terms of improved blasting ability. In this respect, the specific gravity is increased to lie around 2.0 which means that for a given impact velocity, the blasting bodies with a weight of about 0.04 g will strike the utensils and food residues thereon with greater force than obtained by means of known plastics pellets having a weight of less than 0.02 g. In addition, the heavy weight of the blasting bodies makes it possible to reduce considerably the speed at which they are projected while still maintaining a blasting effect superior to that obtained with plastics pellets. This reduction in velocity enables the use of smaller pumps with lower energy consumption, and in addition thereto the lower speed of the water jet-blasting bodies results in a softer impact against the utensils being washed and therewith a marked lowering of the sound level, which is of particular advantage. The heavier weight of the blasting bodies also means that they will separate much more readily from the water, by sinking back into the water jet when it is directed upwardly against the underside of the strainer.

The lower velocity also reduces wear on the nozzle. In order to obtain the best use of the impact force of the heavy blasting bodies, they shall have a form which exhibits a plurality of edges which create cracks in the food residues and, to a certain extent, also scrape along the utensils and the food residues, to remove the same from said utensils. It is believed that the cheapest method of producing such blasting bodies is to extrude molten composite material in strings which, when cool, are then cut into short slugs, which form the blasting bodies. In their simplest form the strings may have a substantially cylindrical configuration with a diameter of about 2.5 mm and a length of about 3 mm, the slugs forming short cylinders with sharp, severed ends presenting edges which can be used to effectively remove food residues from the utensils. The strings, however, may to advantage have a polygonal cross-section, for example a triangular or square cross-section or some other edged cross-section, in order to increase the number of working edges on each blasting body.

If the blasting bodies are too large, there is an added risk of blockages in the spray jets or nozzles, while if the blasting bodies are too small, there is a risk that they will pass through the apertures in the strainer when the blasting bodies are to be separated from the dish-washing water. Consequently, in conjunction with the invention, the blasting bodies shall be of a size which cannot be contained in a sphere which is less than about 2.3 mm in diameter but can be contained in a sphere having a diameter of about 4.8 mm, preferably about 3.8 mm.

When using blasting bodies of the kind proposed in accordance with the invention, the work carried out by the bodies is done so much more effectively than only a relatively small amount of blasting bodies, less than about 6% by volume, is required in the dish-washing water. In addition to this reduction in the running costs, the relatively small amount of blasting bodies in the dish-washing water means that there is far less risk of blockages occurring in the spray nozzles. Wear on the nozzles is also reduced.

As a small extra additive, the composite material may contain a quantity of chalk, to an amount of one or more percent by weight, to add a final polish to the utensils. It is also suitable to add a colouring agent in the mix so that the blasting bodies can be readily observed on the utensils being washed, these utensils normally comprising polished metal, such as stainless steel. This facilitates a final check that no blasting bodies remain on the washed utensils after the dish-washing process.

EXAMPLE

Barium sulphate, nylon 66, chalk and titanium dioxide (colouring agent) are mixed together in respective proportions of 60, 34, 3 and 3% by weight. Barium sulphate and nylon 66 have a specific gravity of 4.4 and 1.13 respectively. Subsequent to producing strings having a diameter of between 2.6 to 3 mm and cutting the strings into slugs having a length of abot 3.0 mm, there are obtained blasting bodies according to the invention having a specific gravity of 2.02. The ready made slugs when seen in cross-section have been slightly flattened to have a greater width than height and with rounded corners.

The proposed quantity of amide resin (nylon) in combination with the proposed quantity of mineral filler, such as barium sulphate, provides in the composite material a mixing ratio which causes minimum wear in pipes while, at the same time, affording satisfactory polishing of the utensils.

Because the blasting bodies according to the invention have a relatively high specific gravity and are therewith relatively heavy, they are able to replace to advantage crushed marble and like materials used in dishwashers in which the blasting bodies are separated from the dish-washing water by settling, the blasting bodies affording advantages not obtained with crushed marble.

I claim:

1. Blasting bodies, for use in dish-washing machines in admixture with dishwashing water, said blasting bodies comprising: about 60% by weight mineral filler selected from the group consisting of silicate, sulphate and carbonate; and a plastic selected from the group consisting of polyamide and polyethylene; the mineral filler being in the form of particles and the plastic constituting a binder for the particles of mineral filler; said bodies having a specific gravity of at least 2.0.

2. Blasting bodies according to claim 1, further comprising at least 1% by weight chalk.

3. Blasting bodies accordng to claim 1, wherein said sulphate is barium sulphate.

4. Blasting bodies according to claim 1, wherein said mineral filler has a Moh's hardness value of at least 3.0.

5. Blasting bodies according to claim 1, each of said bodies having a weight of about 0.04 g.

6. Blasting bodies according to claim 1, each of said bodies having a length of about 3 mm and a width of about 2.5 mm.

7. Blasting bodies according to claim 6, each of said bodies being substantially circular in transverse section.

8. Blasting bodies according to claim 6, each of said bodies being polygonal in transverse section.

* * * * *